US010675859B2

(12) United States Patent
Ito et al.

(10) Patent No.: US 10,675,859 B2
(45) Date of Patent: Jun. 9, 2020

(54) CURVED-SURFACE SCREEN-PRINTING DEVICE, CURVED-SURFACE SCREEN-PRINTING METHOD, AND PRODUCTION METHOD FOR SUBSTRATE HAVING PRINTING LAYER

(71) Applicant: AGC Inc., Chiyoda-ku (JP)

(72) Inventors: Jun Ito, Tokyo (JP); Tomoya Watanabe, Tokyo (JP); Hidenobu Watanabe, Tokyo (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 15/982,642

(22) Filed: May 17, 2018

(65) Prior Publication Data

US 2018/0264800 A1 Sep. 20, 2018

Related U.S. Application Data

(63) Continuation of application No. PCT/JP2016/082937, filed on Nov. 7, 2016.

(30) Foreign Application Priority Data

Nov. 18, 2015 (JP) ..... 2015-226119

(51) Int. Cl.
*B41F 15/08* (2006.01)
*B41M 1/12* (2006.01)
(Continued)

(52) U.S. Cl.
CPC ..... *B41F 15/0809* (2013.01); *B41F 15/0895* (2013.01); *B41F 15/20* (2013.01);
(Continued)

(58) Field of Classification Search
CPC .... B41F 15/0809; B41F 15/38; B41F 15/423; B41F 15/08; B41F 15/20; B41F 15/30;
(Continued)

(56) References Cited

U.S. PATENT DOCUMENTS

| | | | |
|---|---|---|---|
| 6,041,702 | A | 3/2000 | Ichikawa et al. |
| 8,561,535 | B2 | 10/2013 | Sabia et al. |
| 2011/0209634 | A1 | 9/2011 | Sabia et al. |

FOREIGN PATENT DOCUMENTS

| | | |
|---|---|---|
| JP | 3-95236 U | 9/1991 |
| JP | 5-74835 | 10/1993 |

(Continued)

OTHER PUBLICATIONS

English translation of specification of Nunomura (JP 2005-088577 A) which was published Apr. 7, 2005. (Year: 2005).*

(Continued)

*Primary Examiner* — Leslie J Evanisko
(74) *Attorney, Agent, or Firm* — Oblon, McClelland, Maier & Neustadt, L.L.P.

(57) ABSTRACT

The present invention relates to a curved surface screen printing apparatus performing printing on a surface to be printed of a base material having a curved surface, including: a screen plate formed with a pattern and arranged above the base material; a squeegee which is disposed above the screen plate and applies an ink to the surface to be printed of the base material through the screen plate; and a base material moving mechanism which moves the base material along a vertical plane and is capable of swinging the base material with respect to an axis orthogonal to the vertical plane.

21 Claims, 15 Drawing Sheets

(51) Int. Cl.

| | |
|---|---|
| ***B41M 1/40*** | (2006.01) |
| ***B41F 15/16*** | (2006.01) |
| ***B41F 15/30*** | (2006.01) |
| ***B41F 15/20*** | (2006.01) |
| ***B41F 15/38*** | (2006.01) |
| ***B41F 15/42*** | (2006.01) |

(52) U.S. Cl.
CPC ..... *B41F 15/30* (2013.01); *B41F 15/38* (2013.01); *B41F 15/423* (2013.01); *B41M 1/12* (2013.01); *B41M 1/40* (2013.01)

(58) Field of Classification Search
CPC . B41M 1/12; B41N 1/24; B41N 1/247; B41N 1/248
USPC ..... 101/124
See application file for complete search history.

(56) References Cited

FOREIGN PATENT DOCUMENTS

| | | |
|---|---|---|
| JP | 5-254087 | 10/1993 |
| JP | 8-112891 | 5/1996 |
| JP | 8-114257 | 5/1996 |
| JP | 2005-88577 | 4/2005 |
| JP | 3677150 | 7/2005 |

OTHER PUBLICATIONS

International Search Report dated Jan. 24, 2017 in PCT/JP2016/082937, filed on Nov. 7, 2016 (with English Translation).
Written Opinion dated Jan. 24, 2017 in PCT/JP2016/082937, filed on Nov. 7, 2016.

* cited by examiner

CURVED-SURFACE SCREEN-PRINTING DEVICE, CURVED-SURFACE SCREEN-PRINTING METHOD, AND PRODUCTION METHOD FOR SUBSTRATE HAVING PRINTING LAYER

TECHNICAL FIELD

The present invention relates to a curved surface screen printing apparatus, a curved surface screen printing method, and a method for manufacturing a print layer-attached base material. More specifically, the present invention relates to a curved surface screen printing apparatus and curved surface screen printing method capable of printing a pattern on a surface to be printed of the base material having a curved surface, and a method for manufacturing the print layer-attached base material.

BACKGROUND ART

Conventionally, a technique for performing screen printing on a bent base material having a curved surface shape has been known (e.g., see Patent Literatures 1 and 2). Patent Literature 1 discloses a method for performing printing on a surface to be printed having a curved surface shape in which a screen plate according to the shape of the surface to be printed is used and the screen plate is pressed on the surface to be printed by a squeegee. Also, Patent Literature 2 discloses a curved surface screen printing apparatus constructed so as to rotationally drive a screen plate according to the curvature of a surface to be printed so that the screen plate always faces in a tangent direction with respect to the surface to be printed.

Furthermore, Patent Literature 3 discloses that printing is performed by bending a plane glass substrate, rotationally moving a stage so as to be brought into substantially contact with a back surface of a screen plate, and moving a squeegee above the screen plate with a predetermined distance.

CITATION LIST

Patent Literature

Patent Literature 1: U.S. Pat. No. 8,561,535
Patent Literature 2: Japanese Patent No. 3677150
Patent Literature 3: JP-A-2005-88577

SUMMARY OF INVENTION

Technical Problem

In recent years, it is desired to perform screen printing on a base material having a curved surface other than a single curved projected surface shape.

In the printing method described in Patent Literature 1, screen printing is performed with the base material fixed and also, driving of the base material in the case of using the curved screen plate is not described. There is a problem in that the curvature of the surface to be printed capable of being printed is limited.

In the curved surface screen printing apparatus disclosed in Patent Literature 2, a distance between the surface to be printed and the screen plate can be keep constant, but a driving mechanism of a screen plate attachment frame to which the screen plate is attached is located over the screen plate. As a result, powder dust such as abrasion powder of a driving part produced at the time of driving the screen plate drops on the screen plate, which may cause a printing failure such as a pinhole, and there is room for improvement.

The screen printing apparatus disclosed in Patent Literature 3 does not involve that a substrate having a complicated surface to be printed having a curved surface is printed.

The present invention has been implemented in view of the problems described above, and an object of the present invention is to provide a curved surface screen printing apparatus and curved surface screen printing method capable of printing a pattern with high accuracy on a surface of a base material having a curved surface shape, and a method for manufacturing the print layer-attached base material.

Solution to Problem

The above object of the present invention is achieved by the following configurations.

(1) A curved surface screen printing apparatus performing printing on a surface to be printed of a base material having a curved surface, including:

a screen plate formed with a pattern and arranged above the base material, a squeegee which is disposed above the screen plate and applies an ink to the surface to be printed of the base material through the screen plate, and a base material moving mechanism which moves the base material along a vertical plane and is capable of swinging the base material with respect to an axis orthogonal to the vertical plane.

(2) The curved surface screen printing apparatus according to (1), further including a screen plate moving mechanism which moves the screen plate horizontally in synchronization with movement of the base material, in which the squeegee is fixed in a predetermined position.

(3) The curved surface screen printing apparatus according to (1), further including a squeegee moving mechanism which moves the squeegee horizontally in synchronization with movement of the base material, in which the screen plate is fixed in a predetermined position.

(4) The curved surface screen printing apparatus according to any one of (1) to (3), in which the base material moving mechanism is arranged below or in a lateral portion of the screen plate.

(5) The curved surface screen printing apparatus according to any one of (1) to (4), in which the base material moving mechanism includes a pedestal which has a surface shape substantially the same as that of the surface to be printed, and on which the base material is to be placed so as to be projected upwardly.

(6) The curved surface screen printing apparatus according to (5), in which at least a front surface of the pedestal is made of a resin.

(7) The curved surface screen printing apparatus according to (5) or (6), in which the pedestal has a volume resistivity of $10^9$ Ωm or less.

(8) The curved surface screen printing apparatus according to any one of (5) to (7), in which the pedestal includes a suction mechanism that vacuum-sucks and holds the base material.

(9) The curved surface screen printing apparatus according to (2) or (3), in which the base material moving mechanism includes:

a horizontal moving table capable of being moved in a horizontal direction by a horizontal driving mechanism, a vertical moving table which is disposed on the horizontal moving table and is capable of being moved in a vertical direction orthogonal to the horizontal direction by a vertical driving mechanism, and a swinging table which is disposed on the vertical moving table and is capable of being rotated about an axis orthogonal to the horizontal direction and the vertical direction by a swing driving mechanism, and in which the horizontal driving mechanism, the vertical driving mechanism and the swing driving mechanism drive the base material in electrical synchronization with the screen plate moving mechanism or the squeegee moving mechanism.

(10) The curved surface screen printing apparatus according to (2), in which the base material moving mechanism includes a pedestal holder, the pedestal holder is configured to fit into a cam follower fixed to a base, and is formed with a cam groove having a shape substantially the same as that of the surface to be printed of the base material, and on the pedestal holder the pedestal on which the base material is to be placed is to be attached, and in which the base material moving mechanism drives the pedestal holder along the cam groove in synchronization with the screen plate moving mechanism.

(11) The curved surface screen printing apparatus according to (10), in which the base material moving mechanism includes:

a driving member capable of being horizontally moved by a driving force of an actuator of the screen plate moving mechanism, and a power transmitting member which connects the driving member to the pedestal holder and allows to move the pedestal holder by movement of the driving member, and in which the driving member drives the pedestal holder along the cam groove in mechanical synchronization with the screen plate moving mechanism by horizontally moving the driving member in synchronization with the screen plate by the actuator of the screen plate moving mechanism.

(12) The curved surface screen printing apparatus according to (11), in which the power transmitting member includes:

a first chain having a first end fixed to a first movement direction end of the driving member and a second end fixed to a second movement direction end of the pedestal holder, and a second chain having a second end fixed to a second movement direction end of the driving member and a first end fixed to a first movement direction end of the pedestal holder, and in which the driving member is connected to the pedestal holder through the first chain and the second chain.

(13) The curved surface screen printing apparatus according to (10), in which the base material moving mechanism includes:

a rack formed on a lower surface of the pedestal holder, a pinion meshing with the rack, and a motor rotationally driving the pinion, and in which the motor drives the pedestal holder along the cam groove by being rotated in electrical synchronization with the screen plate moving mechanism.

(14) A curved surface screen printing method of performing printing on a surface to be printed of a base material having a curved surface and a plane surface, including:

fixing any one of a screen plate formed with a pattern and arranged above the base material, and a squeegee which is disposed above the screen plate and applies an ink to the surface to be printed of the base material through the screen plate in a predetermined position, and moving the other of the screen plate and the squeegee horizontally in synchronization with movement of the base material while moving the base material along a vertical plane and swinging the base material with respect to an axis orthogonal to the vertical plane, thereby printing a pattern of the screen plate on the surface to be printed of the base material.

(15) A method for manufacturing a print layer-attached base material including a base material having a surface to be printed having a curved surface, and a print layer formed on the surface to be printed, the method including:

providing a screen plate formed with a pattern, and a squeegee disposed above the screen plate, moving the base material along a vertical plane and also swinging the base material with respect to an axis orthogonal to the vertical plane, and applying an ink to the surface to be printed of the base material by the squeegee through the screen plate.

(16) The method for manufacturing the print layer-attached base material according to (15), in which the screen plate is horizontally moved in synchronization with movement of the base material, and the squeegee is fixed in a predetermined position.

(17) The method for manufacturing the print layer-attached base material according to (15), in which the squeegee is horizontally moved in synchronization with movement of the base material, and the screen plate is fixed in a predetermined position.

(18) The method for manufacturing the print layer-attached base material according to any one of (15) to (17), in which the base material is moved by a base material moving mechanism arranged below or in a lateral portion of the screen plate.

(19) The method for manufacturing the print layer-attached base material according to (18), in which the base material moving mechanism includes a pedestal which has a surface shape substantially the same as that of the surface to be printed, and on which the base material is to be placed so as to be projected upwardly.

(20) The method for manufacturing the print layer-attached base material according to (19), in which the pedestal has a volume resistivity of $10^9$ Ωm or less.

Advantageous Effects of Invention

The curved surface screen printing apparatus of the present invention includes a screen plate arranged above a base material, a squeegee which applies an ink to the surface to be printed of the base material through the screen plate, and a base material moving mechanism which moves the base material along a vertical plane and is capable of swinging the base material with respect to an axis orthogonal to the vertical plane. Therefore, a pattern of the screen plate can be printed with high accuracy on the surface of the base material having a curved surface shape.

Also, according to the curved surface screen printing method of the present invention, any one of a screen plate and a squeegee is fixed in a predetermined position, and the other of the screen plate and the squeegee is moved horizontally in synchronization with the movement of a base material while moving the base material along a vertical plane and also swinging the base material with respect to an axis orthogonal to the vertical plane, thereby printing a pattern of the screen plate on a surface to be printed of the base material. Therefore, the pattern of the screen plate can be printed with high accuracy on the surface of the base material having a curved surface shape.

Furthermore, according to the method for manufacturing a print layer-attached base material of the present invention, a screen plate formed with a pattern and a squeegee disposed above the screen plate are provided, a base material is moved along a vertical plane and also is swung with respect to an axis orthogonal to the vertical plane, and the squeegee applies ink to a surface to be printed of the base material through the screen plate. Therefore, the pattern of the screen plate can be printed with high accuracy on the surface of the base material having a curved surface shape.

DESCRIPTION OF EMBODIMENTS

Embodiments of a curved surface screen printing apparatus, a curved surface screen printing method and a method for manufacturing a print layer-attached base material, according to the present invention will hereinafter be described in detail based on the drawings.

First Embodiment

Figure 1:
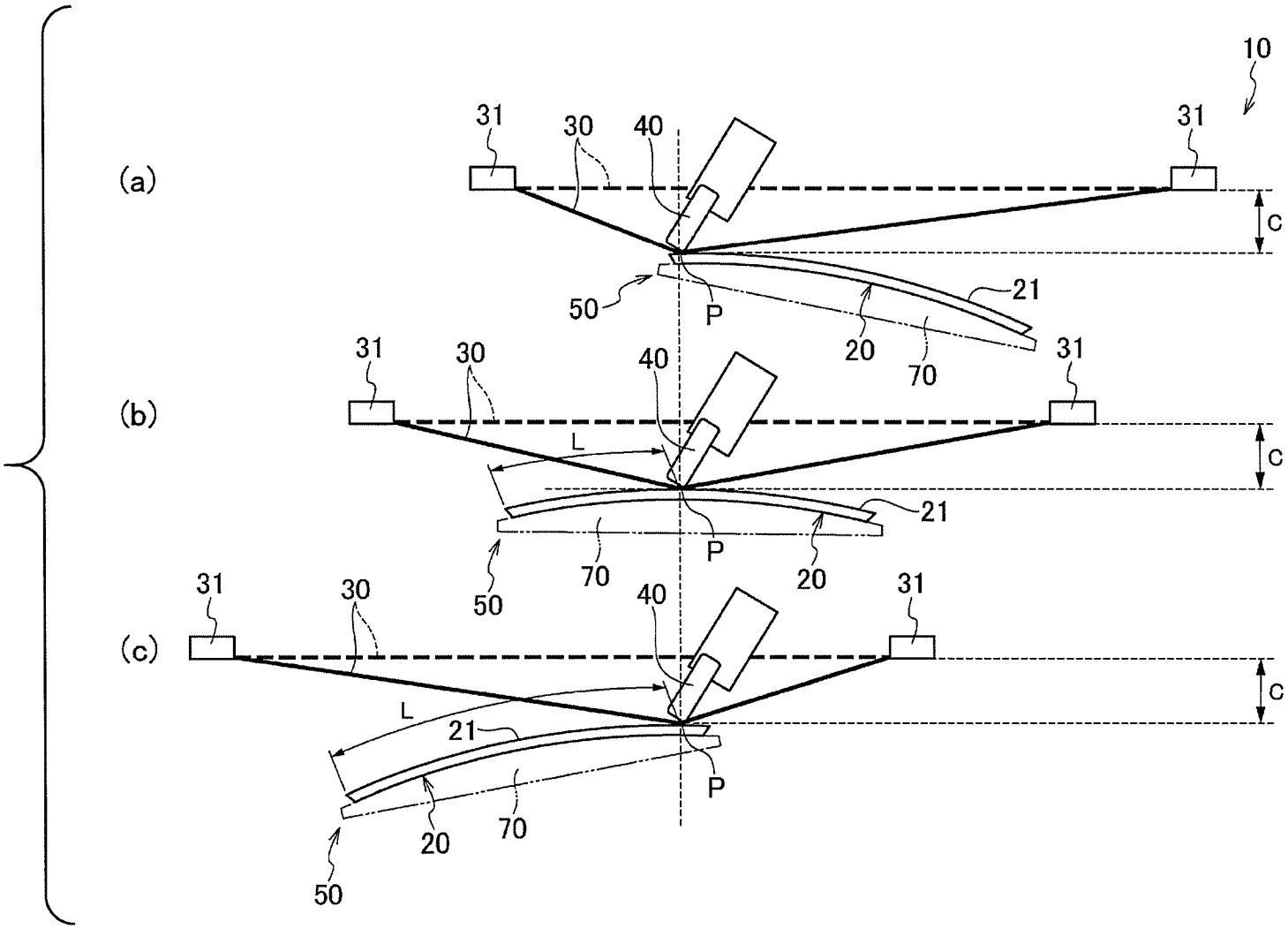
FIGS. 1(*a*), (*b*) and (*c*) of FIG. 1 are schematic diagrams illustrating an operating state of a curved surface screen printing apparatus according to a first embodiment of the present invention.

As illustrated in FIG. 1, a curved surface screen printing apparatus 10 includes a pedestal 70 that holds a base material 20 having a surface 21 to be printed with a curved surface projected upwardly, a base material moving mechanism 50 that drives the base material 20 together with the pedestal 70, a screen plate 30 that is stretched on a frame 31 under a certain tension and installed above the base material 20 through a proper gap C, and a squeegee 40 that is disposed above the screen plate 30 and applies ink to the surface 21 to be printed of the base material 20.

Examples of the base material 20 include plates made of glass, ceramic, resin, wood, metal, and the like. Particularly, Examples of glass include colorless and transparent amorphous glass, crystallized glass, colored glass, and the like.

Also, in the screen plate 30, a metal material or a resin material may be used. Examples of the metal material includes stainless steel and the like. The screen plate 30 is preferably made of the metal material formed with a coating. The coating is preferably a corrosion-resistant and liquid-repellent metal coating containing nickel or the like. On the other hand, examples of the resin material includes TETRON (registered trademark), nylon, polyester, and the like.

Figure 2:
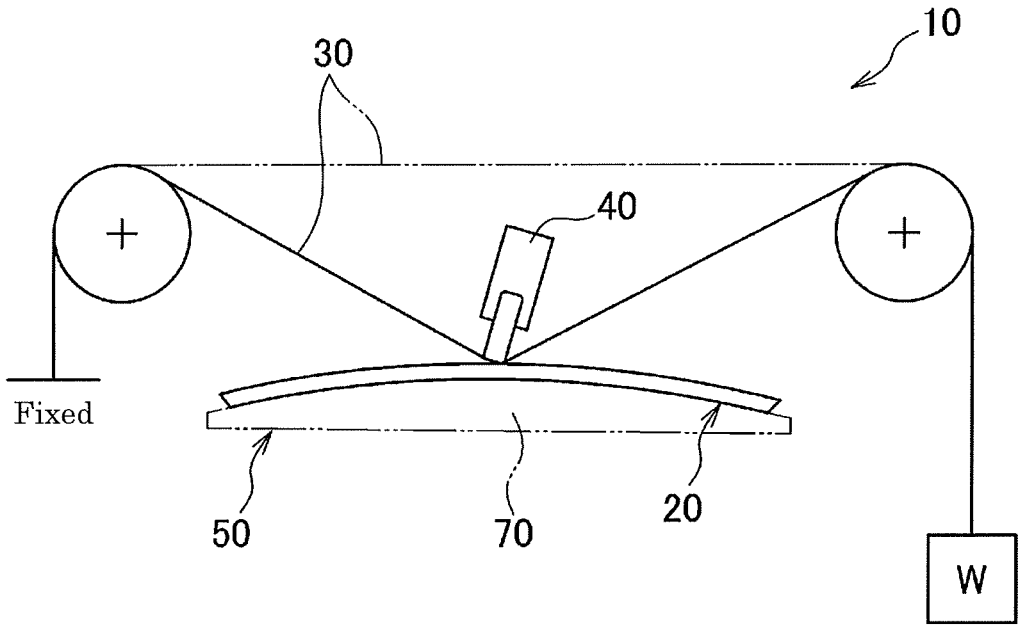
FIG. 2 is a schematic diagram illustrating a modified example of a method for installing a screen plate.

In addition, the screen plate 30 is not limited to one stretched on the frame 31 under a certain tension. As illustrated in FIG. 2, use can be made of a screen plate 30 in which one end is fixed to the frame 31 or the like and a load such as a weight is applied to the other end. In this case, the weight can be selected arbitrarily to adjust the tension of the screen plate 30. In this case, a push load of the squeegee 40 may be changed.

The screen plate 30 is horizontally moved by a screen plate moving mechanism (not illustrated). Also, the pedestal 70 has a surface shape substantially the same as that of the surface 21 to be printed of the base material 20, and is driven in synchronization with the screen plate 30 by the base material moving mechanism 50 (described below). On the other hand, the squeegee 40 is fixed in a predetermined position.

Here, specifically, synchronization movement between the screen plate 30 and the base material 20 means that the base material 20 is driven with respect to horizontal movement of the screen plate 30 so that a gap C between the screen plate 30 (illustrated by a broken line in FIG. 1) before a pressure by the squeegee 40 is applied and a printing position P (the position on the surface 21 to be printed and on which a lower surface of the screen plate 30 comes in substantially contact by being pressed by the squeegee 40) of the surface 21 to be printed is always maintained constant and so that an attack angle of the squeegee 40 is not changed, that is, an angle formed by the squeegee 40 and a tangent at the printing position P of the surface 21 to be printed is maintained constant. Also, the screen plate 30 is horizontally moved in synchronization with movement of the base material 20 by a distance substantially equal to a creepage distance L along the surface 21 to be printed at the time of moving the base material 20. Accordingly, the surface 21 to be printed is brought into contact with the lower surface of the screen plate 30 while the synchronization movement is achieved at the printing position P in all the steps of printing.

Then, a pressure is applied to the squeegee 40 and a back surface of the screen plate 30 is pressed against the surface 21 (front surface) to be printed of the base material 20, and with the squeegee 40 fixed, the screen plate 30 is moved in a left direction in FIG. 1 in synchronization with the base material 20, thereby extruding ink to print a pattern of the screen plate 30 on the surface 21 to be printed.

Figure 3:
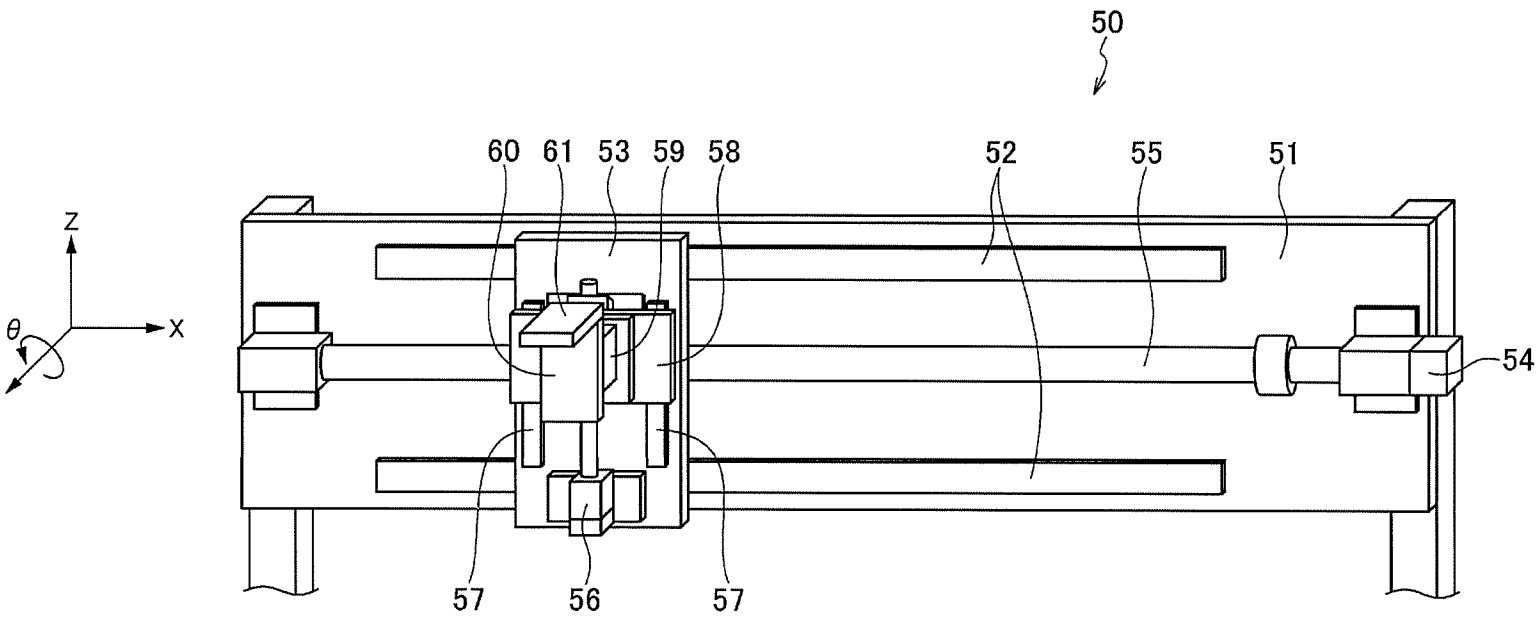
FIG. 3 is a perspective view of main parts of a base material moving mechanism.

As illustrated in FIG. 3, the base material moving mechanism 50 includes a pair of linear guide rails 52 horizontally fixed on a base 51 defining a vertical plane. The linear guide rails 52 are provided with a horizontal moving table 53 capable of being moved in a horizontal direction. The horizontal moving table 53 can be moved in the horizontal direction by, for example, a ball screw mechanism 55 driven through a horizontal driving motor 54 fixed to the base 51.

A vertical moving table 58 is disposed on the horizontal moving table 53. The vertical moving table 58 is driven by a vertical driving motor 56 and is guided by a pair of linear guide rails 57 so as to be movable in a vertical direction. A swinging table 60 is disposed on the vertical moving table 58. The swinging table 60 is driven by a swing driving motor 59 so as to be rotatable about an axis orthogonal to the horizontal direction and the vertical direction. The swinging table 60 is formed in substantially an L shape, and the pedestal 70 (see FIG. 4 and FIG. 6) on which the base material 20 is to be placed is fixed to a projection 61 projected from an upper portion of the swinging table 60 to the front side of the paper.

The horizontal moving table 53, vertical moving table 58 and swinging table 60 may also be constituted of another horizontal moving mechanism, another vertical moving mechanism and another swinging driving mechanism so long as they are mechanisms capable of moving in the horizontal direction, moving in the vertical direction and rotating, respectively, and are not limited to the movement and rotation caused by a combination of the motor and ball screw mechanism.

Figure 4:
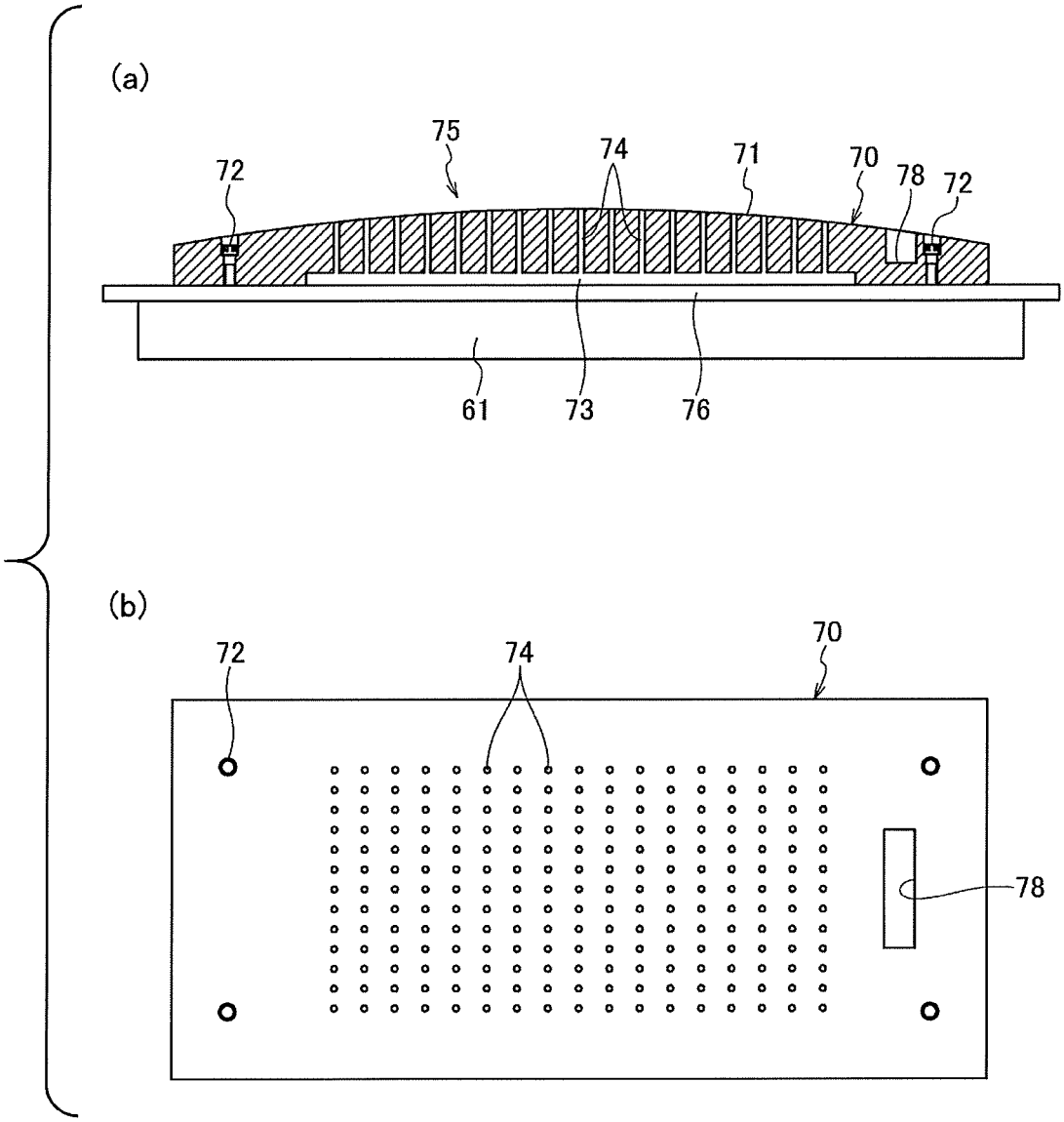
FIG. 4(*a*) of FIG. 4 is a cross-sectional view of a pedestal on which a base material is to be placed, and (b) of FIG. 4 is a top view of the pedestal illustrated in (a) of FIG. 4.

As illustrated in FIG. 4, in the pedestal 70, a material softer than the base material 20, for example, a carbon or a resin can be used. As the resin, use can be made of, for example, BAKELITE (registered trademark), PEEK (registered trademark), vinyl chloride, DURACON (registered trademark), and the like. These resins may be subjected to a surface treatment using a conductive film and the like for imparting conductivity thereto, or may be mixed with carbon or the like. Also, the pedestal 70 has a front surface 71 with an upwardly projected shape substantially the same as the shape of the surface 21 to be printed of the base material 20, and is placed and fixed to the projection 61 of the swinging table 60. The pedestal 70 (at least the front surface 71 of the pedestal 70) has a volume resistivity of desirably $10^9$ Ωm or less, and more desirably $10^7$ Ωm to $10^8$ Ωm. This suppresses static electricity generated at the time of printing, enhances plate removal of the screen plate 30 from the surface 21 to be printed, and further improves stopping of ink. Therefore, printing accuracy can be enhanced without contamination of the plate. Also, since the static electricity can be reduced, foreign substances such as dust are not attracted and a good print layer can be formed.

A plate 76 is fixed to a back surface of the pedestal 70 by screws 72, and a plurality of holes 74 opened in the front surface 71 of the pedestal 70 are communicated to recess space 73 formed between the pedestal 70 and the plate 76. The recess space 73 is connected to a vacuum apparatus (not illustrated), and constructs a suction mechanism 75 that sucks external air from the holes 74 to vacuum-suck the base material 20 to the front surface 71 of the pedestal 70.

Also, the front surface 71 of the pedestal 70 is formed with a recess 78 in a position of passage of the edge (one side of the base material 20 in the present embodiment) of the base material 20. A back surface of the base material 20 faces the opening side of the recess 78. The recess 78 is formed in order that, after printing, a hand, a spatula or the like is inserted therein to lift the base material 20 and detach the base material 20 from the pedestal 70 without touching the print surface. As a result, the recess 78 has a size capable of inserting the hand, spatula or the like, and is formed along one side of the base material 20 in the present embodiment.

Figure 5:
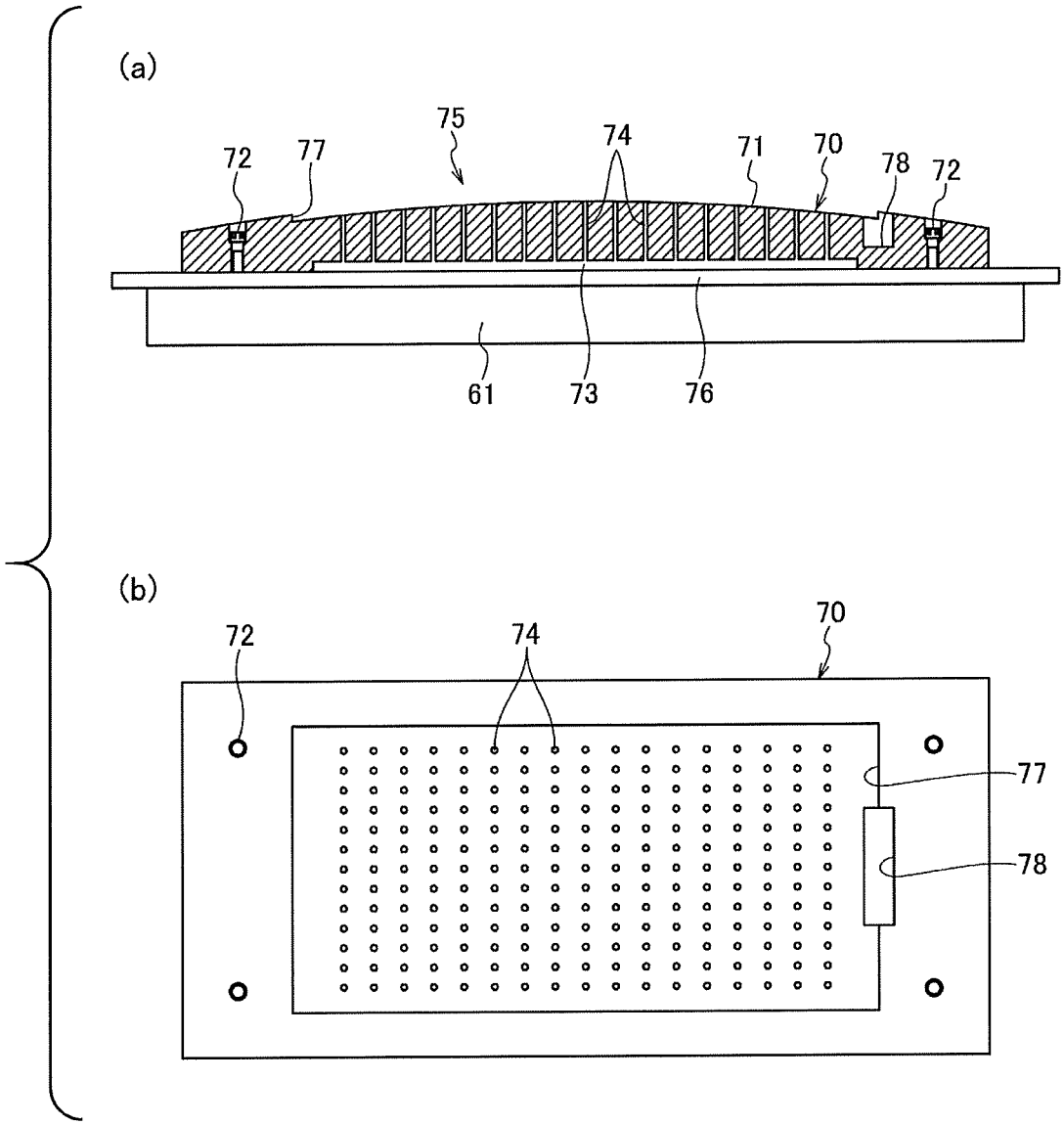
FIG. 5(*a*) of FIG. 5 is a cross-sectional view illustrating a modified example of a pedestal on which a base material is to be placed, and (b) of FIG. 5 is a top view of the pedestal illustrated in (a) of FIG. 5.

A method for fixing the base material 20 to the pedestal 70 is not limited to the vacuum suction described above, and a groove having a shape the same as that of the base material 20 may be formed and the base material 20 may be fitted into the groove. Also, both of these methods may be combined. That is, as a modified example using both of these methods in combination, as illustrated in FIG. 5, the front surface 71 of the pedestal 70 is formed with a groove 77 having a shape the same as that of the base material 20. In this case, the groove 77 passes through the recess 78 in top view.

The horizontal driving motor 54, vertical driving motor 56 and swing driving motor 59 of the base material moving mechanism 50 are driven in electrical synchronization with the screen plate moving mechanism for horizontally moving the screen plate 30, and swing the pedestal 70 together with the swinging table 60 about the axis orthogonal to the horizontal direction and the vertical direction, and also move a shaft **60*a* of the swinging table 60 in the horizontal direction and the vertical direction. Accordingly, the base material 20 is driven in synchronization so that the gap C between the screen plate 30 before a pressure by the squeegee 40 is applied and the printing position P (the position on the surface 21 to be printed and on which the lower surface of the screen plate 30 comes in substantially contact by being pressed by the squeegee 40) of the surface 21** to be printed is always maintained constant.

Figure 6:
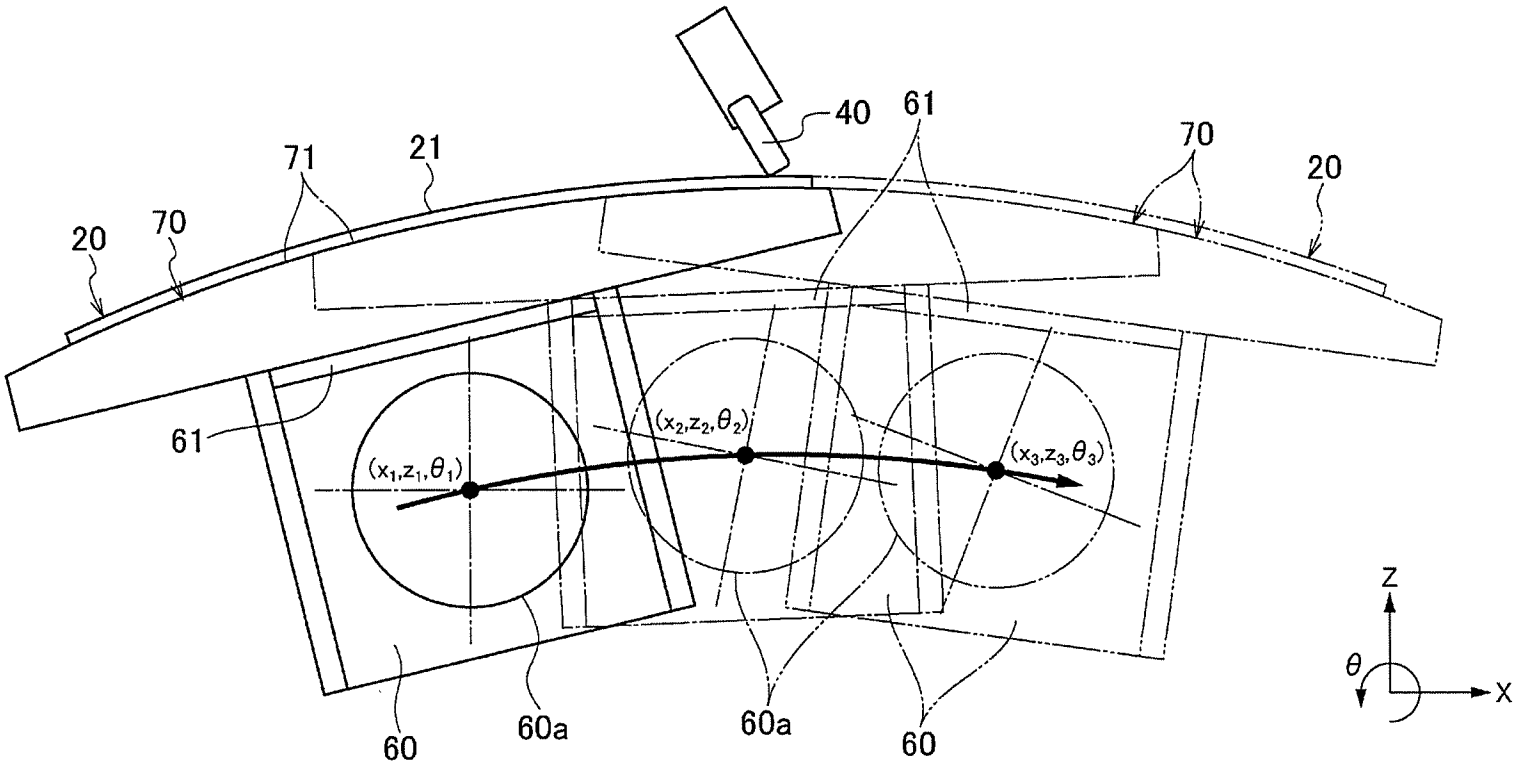
FIG. 6 is a front view illustrating a movement locus of the pedestal.

In the case where the surface 21 to be printed is a single curved projected surface, as illustrated in FIG. 6, the base material 20 is driven so as to be rotated about the center of curvature of the surface 21 to be printed, and the surface 21 to be printed of the base material 20 is moved on an extended line (circular arc) of the curved surface of the surface 21 to be printed in a direction illustrated by an arrow in the drawing. In that case, the center of shaft **60*a* of the swinging table 60** is moved from the coordinate $(x_1, z_1, \theta_1)$ indicated by a solid line just after a start of printing to the coordinate $(x_3, z_3, \theta_3)$ indicated by a two-dot chain line through the coordinate $(x_2, z_2, \theta_2)$ indicated by a one-dot chain line.

Accordingly, as illustrated in FIG. 1, with the squeegee 40 fixed, the base material 20 and the screen plate 30 are moved in synchronization, and printing can be performed with high accuracy on the surface 21 to be printed.

As described above, the curved surface screen printing apparatus 10 of the present embodiment includes the screen plate 30 formed with the pattern and arranged above the base material 20, the squeegee 40 which is disposed above the screen plate 30 and applies ink to the surface 21 to be printed of the base material 20 through the screen plate 30, and the base material moving mechanism 50 which moves the base material 20 along the vertical plane and is capable of swinging the base material 20 with respect to the axis orthogonal to the vertical plane. Therefore, the pattern of the screen plate 30 can be printed with high accuracy on the surface 21 to be printed of the base material 20 having a curved surface shape.

Also, the curved surface screen printing apparatus 10 of the present embodiment further includes the screen plate moving mechanism which moves the screen plate 30 horizontally in synchronization with movement of the base material 20, and the squeegee 40 is fixed in a predetermined position. Therefore, synchronization of the screen plate 30 with the base material 20 can be easily achieved, and printing with high accuracy can be performed.

Also, the base material moving mechanism 50 is arranged below or in a lateral portion of the screen plate 30. Therefore, powder dust such as abrasion powder produced with operation of the base material moving mechanism 50 does not drop on the screen plate 30 and thus, a printing failure such as a pinhole is prevented.

Also, the base material moving mechanism 50 include the pedestal 70 which has the surface shape substantially the same as that of the surface 21 to be printed, and on which the base material 20 is to be placed so as to be projected upwardly. Therefore, the base material 20 can be surely positioned and held.

Also, at least the front surface of the pedestal 70 is made of carbon or a resin. Since the front surface 71 of the pedestal 70 is softer than the base material 20, there is no fear of damaging the base material 20 by the pedestal 70.

Also, the volume resistivity of the pedestal 70 is $10^9$ Ωm or less. Therefore, static electricity is hardly generated, and plate removal of the screen plate 30 from the surface 21 to be printed is enhanced, and stopping of ink is improved. Therefore, printing accuracy can be enhanced without contamination of the plate. Also, since the static electricity can be reduced, foreign substances such as dust are not attracted and a good print layer can be formed.

Also, the pedestal 70 includes the suction mechanism 75 which vacuum-sucks and holds the base material 20. Therefore, the base material 20 can be surely held by the pedestal 70.

Also, the base material moving mechanism 50 includes the horizontal moving table 53 capable of being moved in the horizontal direction by being driven by the horizontal driving motor 54, the vertical moving table 58 that is disposed on the horizontal moving table 53 and is movable in the vertical direction by being driven by the vertical driving motor 56, and the swinging table 60 that is disposed on the vertical moving table 58 and is rotatable about the axis orthogonal to the horizontal direction and the vertical direction by being driven by the swing driving motor 59, and the horizontal driving motor 54, vertical driving motor 56 and swing driving motor 59 drive the base material 20 in electrical synchronization with the screen plate moving mechanism. Therefore, the base material 20 can be driven in any movement locus according to the curved surface shape of the surface 21 to be printed of the base material 20.

Also, according to the curved surface screen printing method of the present embodiment, the squeegee 40 is fixed in a predetermined position, and the screen plate 30 is moved horizontally in synchronization with the movement of the base material 20 while moving the base material 20 along the vertical plane and also swinging the base material 20 with respect to the axis orthogonal to the vertical plane, thereby printing the pattern of the screen plate 30 on the surface 21 to be printed of the base material 20. Therefore, the pattern of the screen plate 30 can be printed with high accuracy on the surface 21 to be printed of the base material 20 having a curved surface shape.

Second Embodiment

Next, a curved surface screen printing apparatus 10 according to a second embodiment of the present invention will be described. The present embodiment differs from the first embodiment in that the apparatus 10 has a base material moving mechanism 50A that achieves mechanical synchronization with a screen plate moving mechanism 100. Therefore, the same numerals are assigned to the components same as or equivalent to those of the first embodiment, and descriptions thereof are omitted or simplified.

Figure 7:
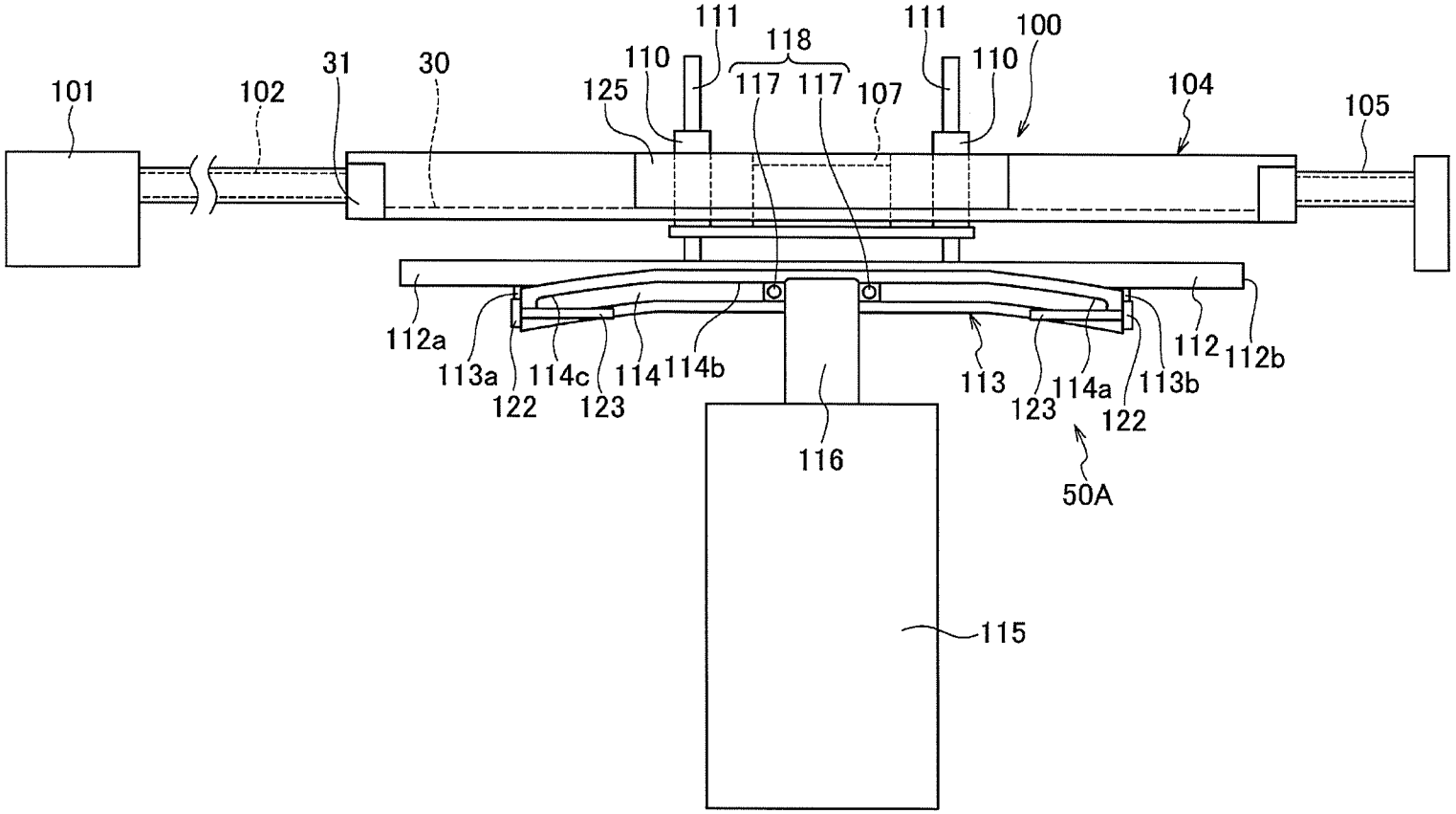
FIG. 7 is a front view of a base material moving mechanism of a second embodiment.
Figure 8:
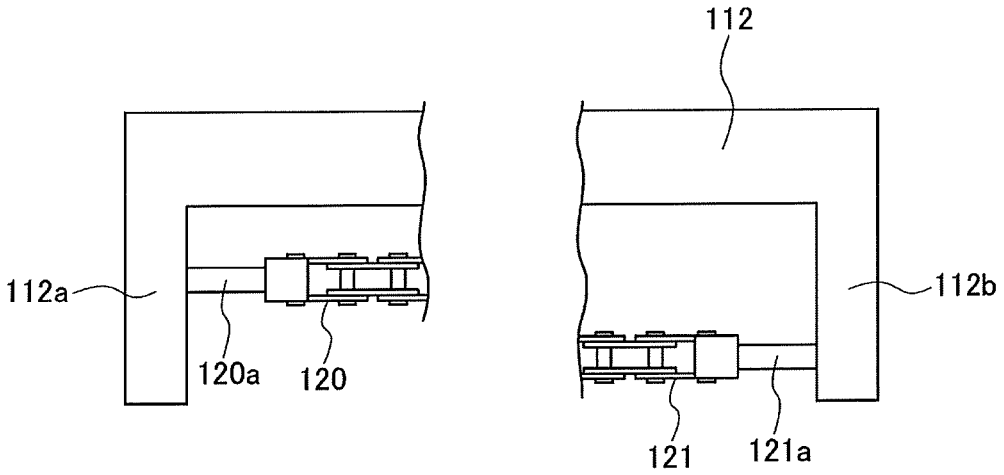
FIG. 8 is an enlarged view of main parts for explaining attachment of first and second chains to a driving member.
Figure 9:
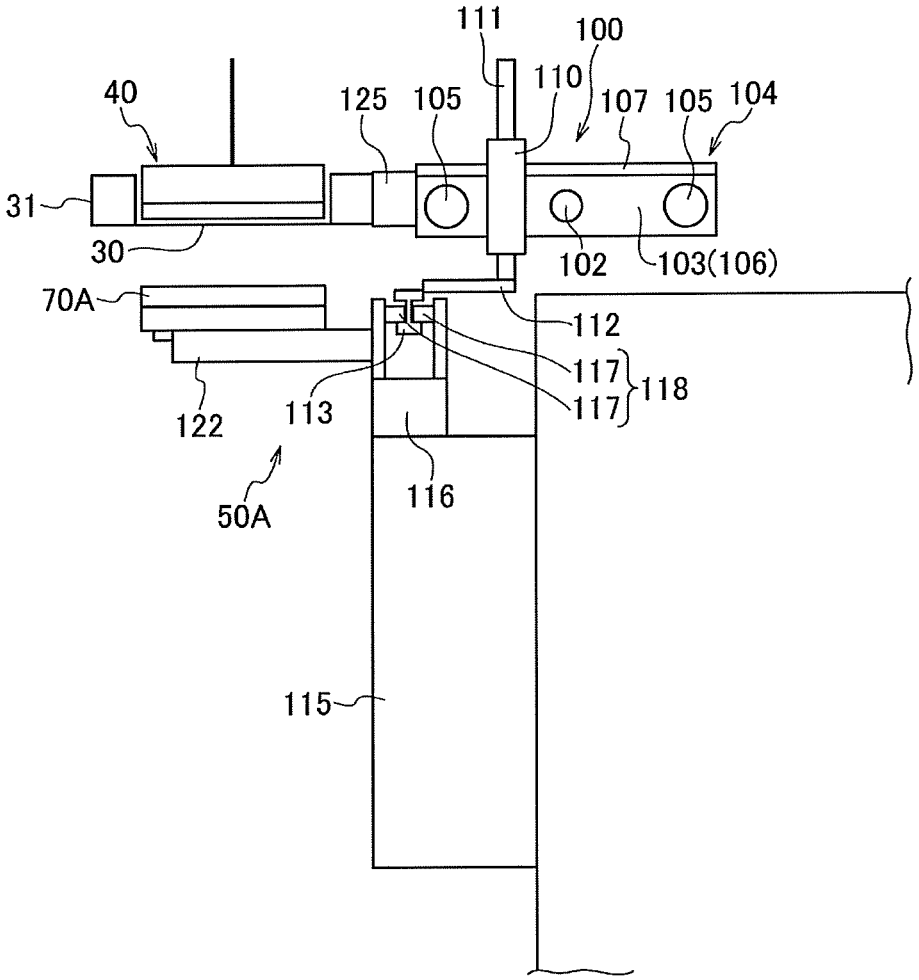
FIG. 9 is a side view of the base material moving mechanism illustrated in FIG. 7.

In this second embodiment, the base material moving mechanism 50A is constructed so as to be driven by an actuator 101 of the screen plate moving mechanism 100 and be mechanically synchronized with the screen plate moving mechanism 100, as illustrated in FIG. 7 to FIG. 9.

The screen plate moving mechanism 100 includes a screen plate attachment part 104 to which a frame 31 of a screen plate 30 is attached, a ball screw 102 rotationally driven by an actuator 101, a nut 103 that is fixed to the screen plate attachment part 104 and is horizontally moved with rotation of the ball screw 102, and a pair of guide rods 105 that guides the screen plate attachment part 104.

The screen plate attachment part 104 includes a guide member 106 into which the pair of guide rods 105 is inserted, and a substrate 107 to which the guide member 106 and the nut 103 are fixed. Accordingly, the screen plate 30, together with the screen plate attachment part 104, is horizontally moved by being driven by the actuator 101.

In the present embodiment, the nut 103 and the guide member 106 are integrated, but the nut 103 and the guide member 106 may be separately fixed to the substrate 107.

Also, in the present embodiment, the frame 31 holding the screen plate 30 is fixed to the screen plate attachment part 104 through a plate attachment jig 125, but the frame 31 may be directly fixed to the screen plate attachment part 104.

A pair of linear guides 110 is fixed to the substrate 107 in a vertical direction. The lower ends of a pair of shafts 111 fitted into the pair of linear guides 110 are fixed to a driving member 112. In a lower portion of the driving member 112, a pedestal holder 113 formed with a pair of cam grooves 114 with the same shape in front and back surfaces is arranged.

A cam shape of the cam groove 114 is a shape substantially the same as that of a surface 21 to be printed of a base material 20. A cam follower part 118 that is fixed to a movable base 116 guided by an upward and downward driving mechanism 115 and moved upwardly and downwardly and is made of a pair of cam followers 117 horizontally arranged to left and right is fitted into each of the cam grooves 114 from the front and back surfaces. Accordingly, the pedestal holder 113 is supported on the movable base 116 through the pair of front and back cam follower parts 118, and can be upwardly and downwardly moved together with the movable base 116.

The driving member 112 is mutually coupled to the pedestal holder 113 through two chains 120, 121 spanned there across as illustrated in FIG. 8. That is, in the first chain 120, a first end 120*a* is fixed to a first movement direction end 112*a* of the driving member 112, and a second end (not illustrated) is fixed to a second movement direction end 113*b* of the pedestal holder 113. In the second chain 121, a second end 121*a* is fixed to a second movement direction end 112*b* of the driving member 112, and a first end (not illustrated) is fixed to a first movement direction end 113*a* of the pedestal holder 113.

Here, power transmission between the driving member 112 and the pedestal holder 113 is not limited to power transmitting members of the two chains 120 and 121 described above, and may be formed by another power transmitting member such as a belt or a wire. That is, the power transmitting member only has to be a member that connects the driving member 112 to the pedestal holder 113 and allows to move the pedestal holder 113 by movement of the driving member 112.

Figure 10:
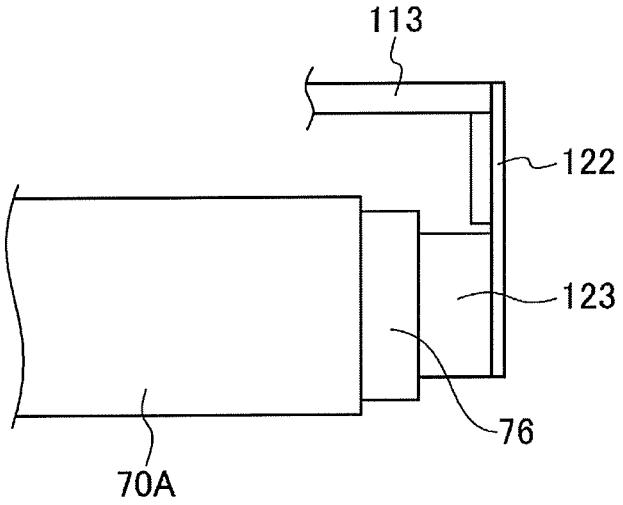
FIG. 10 is a plan view of main parts illustrating a state of attachment of the pedestal to a pedestal holder illustrated in FIG. 9.

Also referring to FIG. 10, a pair of support arms 122 extending forward from both left and right ends of the pedestal holder 113 is provided with a pair of pedestal attachment arms 123 respectively extending toward the inside. A pedestal 70A made of carbon or a resin is attached to the pair of pedestal attachment arms 123 through a plate 76, like the pedestal 70 described above.

Figure 11:
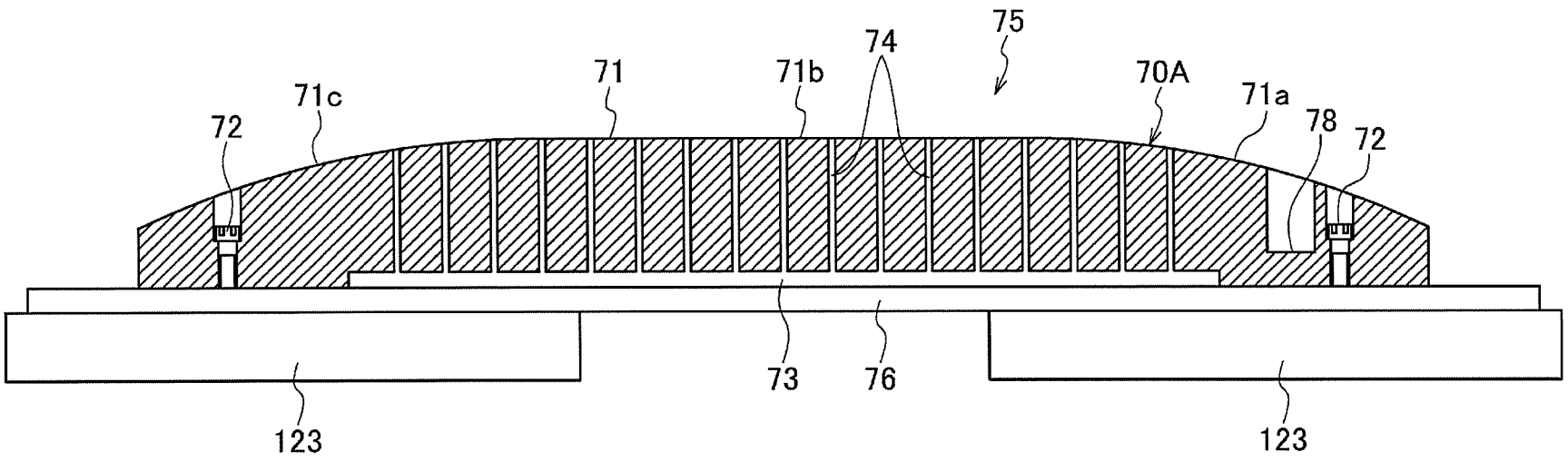
FIG. 11 is a cross-sectional view of a pedestal on which a base material is to be placed.

As illustrated in FIG. 11, a shape of a front surface 71 of the pedestal 70A is a shape substantially the same as that of the surface 21 to be printed of the base material 20. That is, the shape of the front surface 71 of the pedestal 70A of the present embodiment is formed in a composite curved surface having curved surfaces 71*a* and 71*c* formed on both ends and a plane surface 71*b* formed between the curved surfaces. Also, a cam shape of the cam groove 114 of the pedestal holder 113 is formed in a composite curved line in which curved line parts 114*a* and 114*c* are formed on both ends and a straight line part 114*b* is formed between the curved line parts in conformity with the shape of the surface 21 to be printed (the pedestal 70A).

Like the pedestal 70 of the first embodiment illustrated in FIG. 4, the pedestal 70A includes recess space 73 between the pedestal 70A and the plate 76, and a plurality of holes 74 opened in the front surface 71 of the pedestal 70A are communicated thereto. The recess space 73 is connected to a vacuum apparatus (not illustrated), and constructs a suction mechanism 75 that sucks external air from the holes 74 to vacuum-suck the base material 20 to the front surface 71 of the pedestal 70A. Also, the pedestal 70A has a volume resistivity of desirably $10^9$ Ωm or less.

Figure 12:
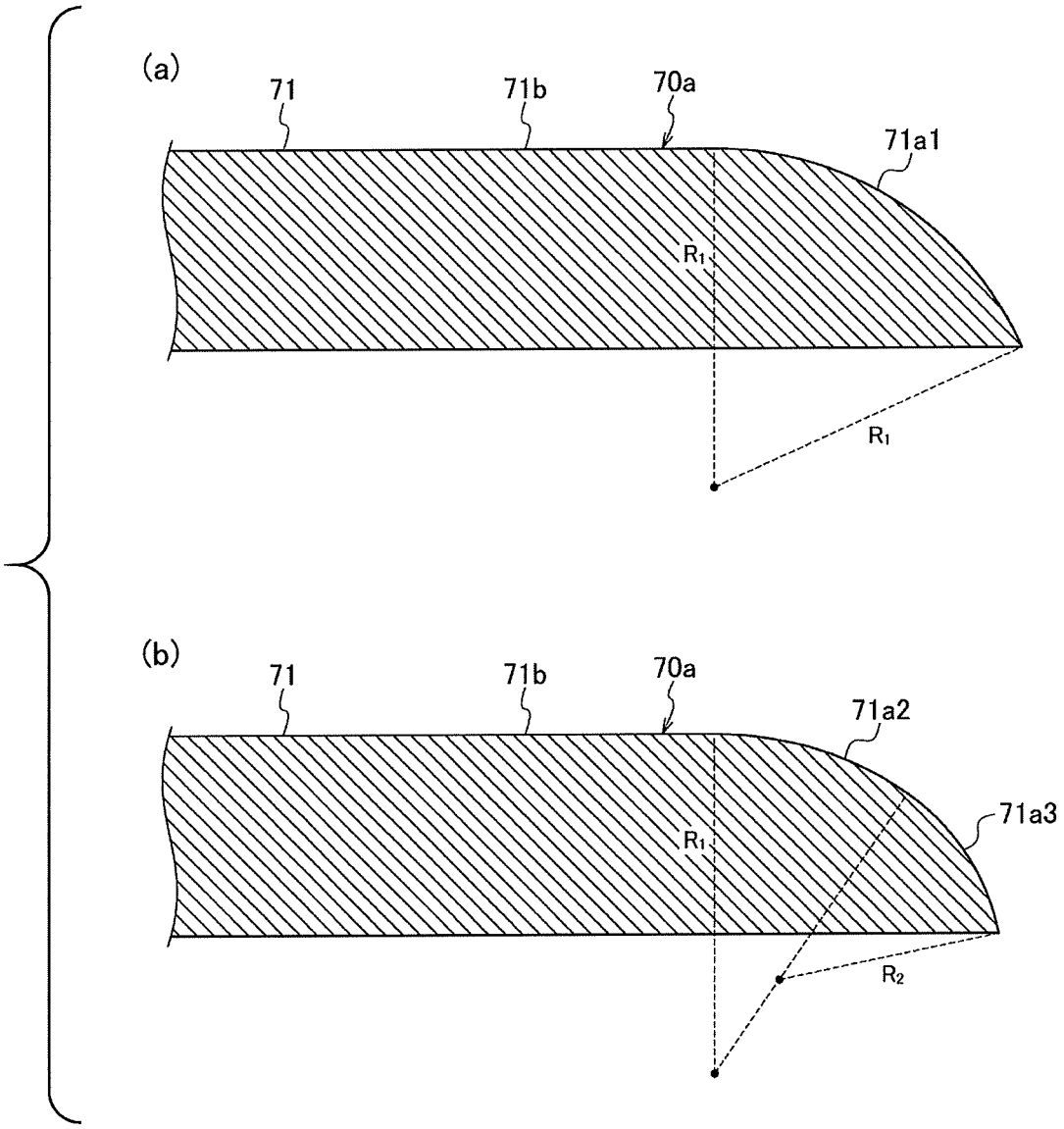
FIG. 12(*a*) of FIG. 12 is an enlarged view of main parts of a pedestal of a modified example, and (b) of FIG. 12 is an enlarged view of main parts of a pedestal of another modified example.

The shape of the front surface 71 of the pedestal 70A is not limited to the composite curved surface having the curved surfaces 71*a* and 71*c* and the plane surface 71*b* as illustrated in FIG. 11. For example, as illustrated in (a) of FIG. 12, the shape may be a composite curved surface having a curved surface 71*a*1 formed of a curved line with a single curvature radius $R_1$ and a plane surface 71*b*, or may be, as illustrated in (b) of FIG. 12, a composite curved surface having a plurality of curved surfaces 71*a*2 and 71*a*3 formed of curved lines with mutually different curvature radii $R_1$ and $R_2$ and a plane surface 71*b*. In addition, the composite curved surface of the pedestal 70A may be formed of a plurality of curved surfaces formed of curved lines with respectively different curvature radii without having a plane surface.

Next, action of the base material moving mechanism 50A will be described with reference to FIG. 13.

First, the base material 20 is vacuum-sucked to the front surface 71 of the pedestal 70A and is held. Then, the movable base 116 is upwardly moved by the upward and downward driving mechanism 115. That is, the pedestal holder 113 supported on the movable base 116 through the pair of front and back cam follower parts 118 is upwardly moved together with the base material 20 held on the pedestal 70A to a position at which a gap between the base material 20 and the screen plate 30 reaches a predetermined gap C (see FIG. 1). At this time, the driving member 112 coupled by the first chain 120 and the second chain 121 is upwardly moved together with the pedestal holder 113.

Then, when the ball screw 102 is rotated by the actuator 101 of the screen plate moving mechanism 100, the substrate 107 fixed to the nut 103 screwed into the ball screw 102, that is, the screen plate attachment part 104 is horizontally moved together with the screen plate 30.

Also, since the linear guides 110 fixed to the substrate 107 are simultaneously horizontally moved, the driving member 112 fixed to the pair of shafts 111 fitted into the linear guides 110 is also horizontally moved and in addition, the pedestal holder 113 coupled to the driving member 112 by the pair of chains 120 and 121 is also horizontally moved. Accordingly, the pedestal holder 113 is guided to the cam follower parts 118 of the movable base 116 stopped in an upward position, and is driven according to the cam shape of the cam groove 114.

That is, when the driving member 112 (the screen plate attachment part 104) is, for example, horizontally moved in a right direction in a state where the cam follower 117 is fitted into the cam groove 114, the pedestal holder 113 is pulled by the second chain 121 to move in the right direction. Since the cam follower 117 fitted into the cam groove 114 is in a fixed position at this time, the pedestal holder 113 is swung and linearly moved according to the cam shape of the cam groove 114.

Figure 13:
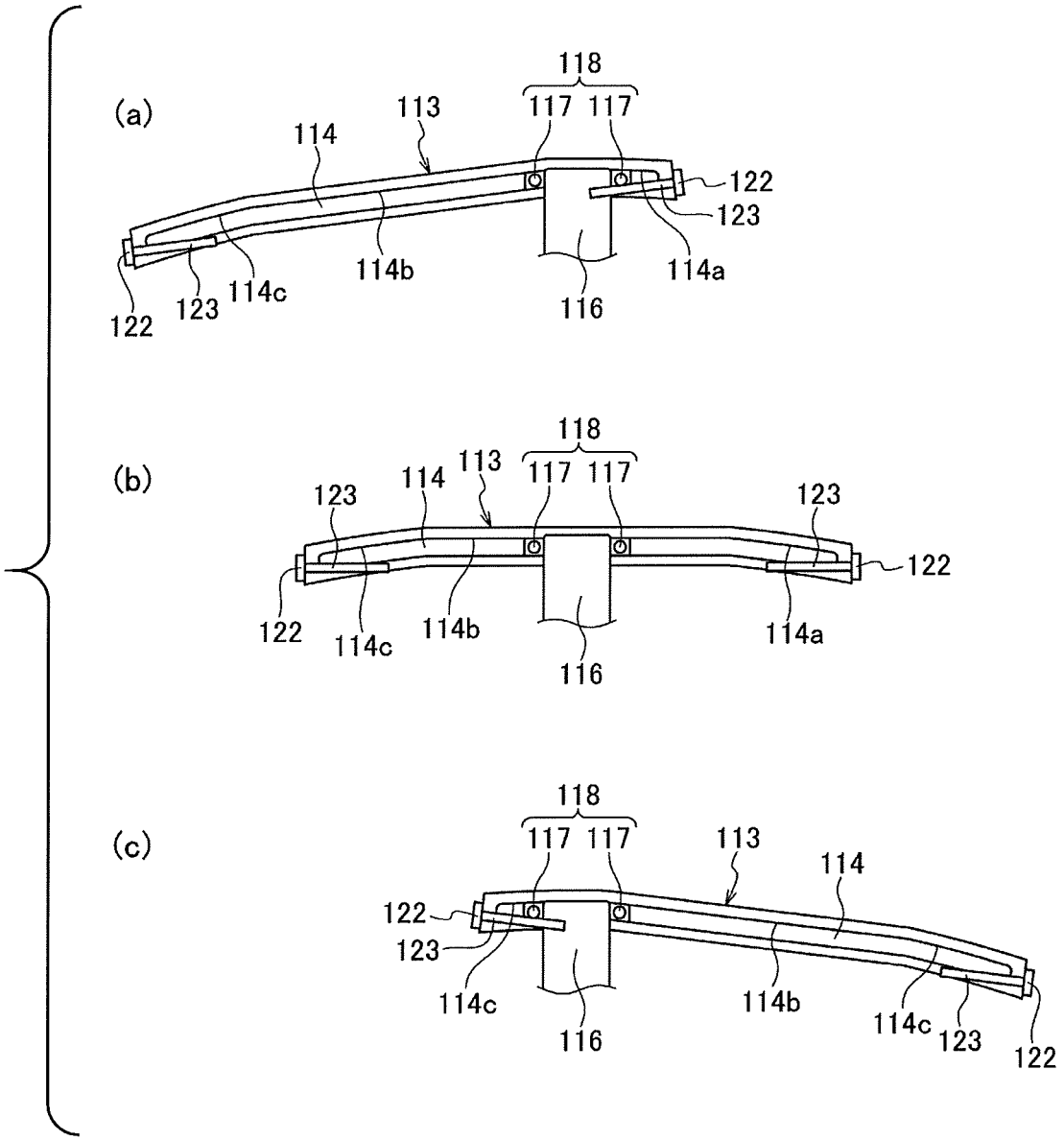
FIGS. 13(*a*), (*b*) and (*c*) of FIG. 13 are front views of main parts illustrating an operating state of the base material moving mechanism illustrated in FIG. 7.

Specifically, when the pedestal holder 113 is moved in the right direction, in a position in which the cam follower 117 is fitted into the curved line part 114*a* of the right end of the cam groove 114, the pedestal holder 113 is moved while being swung according to the curved line part 114*a* (see (a) of FIG. 13); and in a position in which the cam follower 117 is fitted into the intermediate straight line part 114*b*, the pedestal holder 113 is linearly moved according to the straight line part 114*b* (see (b) of FIG. 13); and in a position in which the cam follower 117 is fitted into the curved line part 114*c* of the left end, the pedestal holder 113 is moved while being swung according to the curved line part 114*c* (see (c) of FIG. 13). Accordingly, the pedestal holder 113 is driven according to the shape of the cam groove 114, that is, the surface 21 to be printed of the base material 20.

Similarly, when the driving member 112 (the screen plate attachment part 104) is, for example, horizontally moved in a left direction, the pedestal holder 113 is pulled by the first chain 120 to move in the left direction, and in positions in which the cam follower 117 is fitted into the curved line parts 114*a* and 114*c* of left end and the right end of the cam groove 114, the pedestal holder 113 is moved while being swung, and in a position in which the cam follower 117 is fitted into the intermediate straight line part 114*b*, the pedestal holder 113 is linearly moved, whereby the pedestal holder 113 is driven according to the shape of the surface 21 to be printed.

Accordingly, the base material 20, together with the screen plate 30, is driven by the actuator 101 of the screen plate moving mechanism 100, and is controlled so that the gap C between the screen plate 30 before a pressure by a squeegee 40 is applied and the printing position P (the position on the surface 21 to be printed and on which the lower surface of the screen plate 30 comes in substantially contact by being pressed by the squeegee 40) of the surface 21 to be printed is always maintained constant, and the base material 20 is horizontally driven and swung in mechanical synchronization with the screen plate 30.

Figure 14:
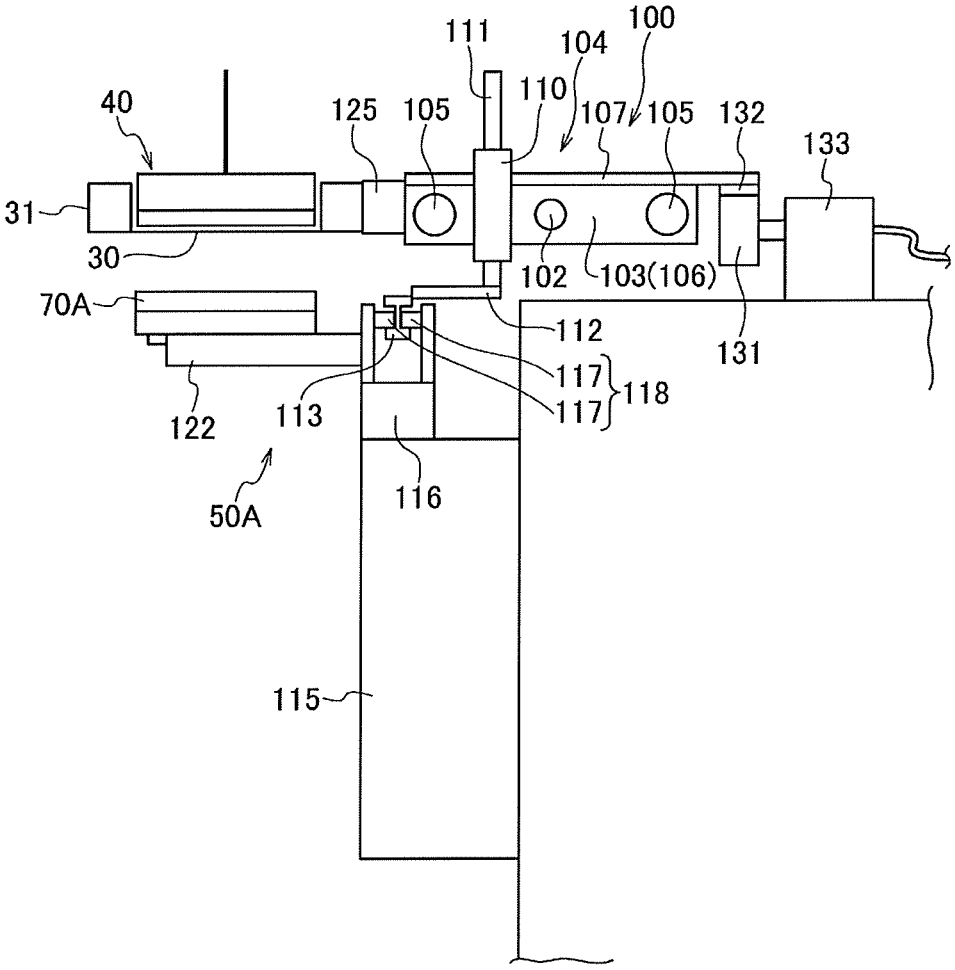
FIG. 14 is a side view of a base material moving mechanism of a modified example of the second embodiment.

FIG. 14 is a side view of a curved surface screen printing apparatus of a modified example of the second embodiment. In the curved surface screen printing apparatus 10 of the present modified example, a driving source of a screen plate moving mechanism 100 is constructed of a rack-and-pinion mechanism including a pinion 131 driven by a motor 133 and a rack 132 that is fixed to a lower surface of a substrate 107 and meshes with the pinion 131, instead of a ball screw mechanism. Since the other configuration is similar to that of the curved surface screen printing apparatus 10 of the second embodiment, the same numerals are assigned to the same components and detailed descriptions thereof are omitted.

As described above, according to the curved surface screen printing apparatus 10 of the present embodiment, the base material moving mechanism 50A includes the pedestal holder 113. The pedestal holder 113 is configured to fit into the cam follower 117 fixed to the movable base 116, and is formed with the cam groove 114 having the shape substantially the same as that of the surface 21 to be printed of the base material 20, and on the pedestal holder the pedestal 70A on which the base material 20 to be placed is to be attached. The base material moving mechanism 50A drives the pedestal holder 113 along the cam groove 114 in synchronization with the screen plate moving mechanism 100. Accordingly, screen printing can be performed on the base material 20 having the surface 21 to be printed with any two-dimensional curved line by replacing the pedestal 70A and the pedestal holder 113.

Also, the base material moving mechanism 50A further includes the driving member 112 capable of being horizontally moved, the first chain 120 having the first end 120*a* fixed to the first movement direction end 112*a* of the driving member 112 and the second end fixed to the second movement direction end 113*b* of the pedestal holder 113, and the second chain 121 having the second end 121*a* fixed to the second movement direction end 112*b* of the driving member 112 and the first end fixed to the first movement direction end 113*a* of the pedestal holder 113. The driving member 112 is mutually coupled to the pedestal holder 113 through the first chain 120 and the second chain 121, and the base material moving mechanism 50A is driven in mechanical synchronization with the screen plate moving mechanism 100 by horizontally moving the driving member 112 in synchronization with the screen plate 30 by the actuator 101 of the screen plate moving mechanism 100. Therefore, the base material 20 can be driven in synchronization with the screen plate 30 in the same movement locus as a curved surface shape of the surface 21 to be printed.

Third Embodiment

Figure 15:
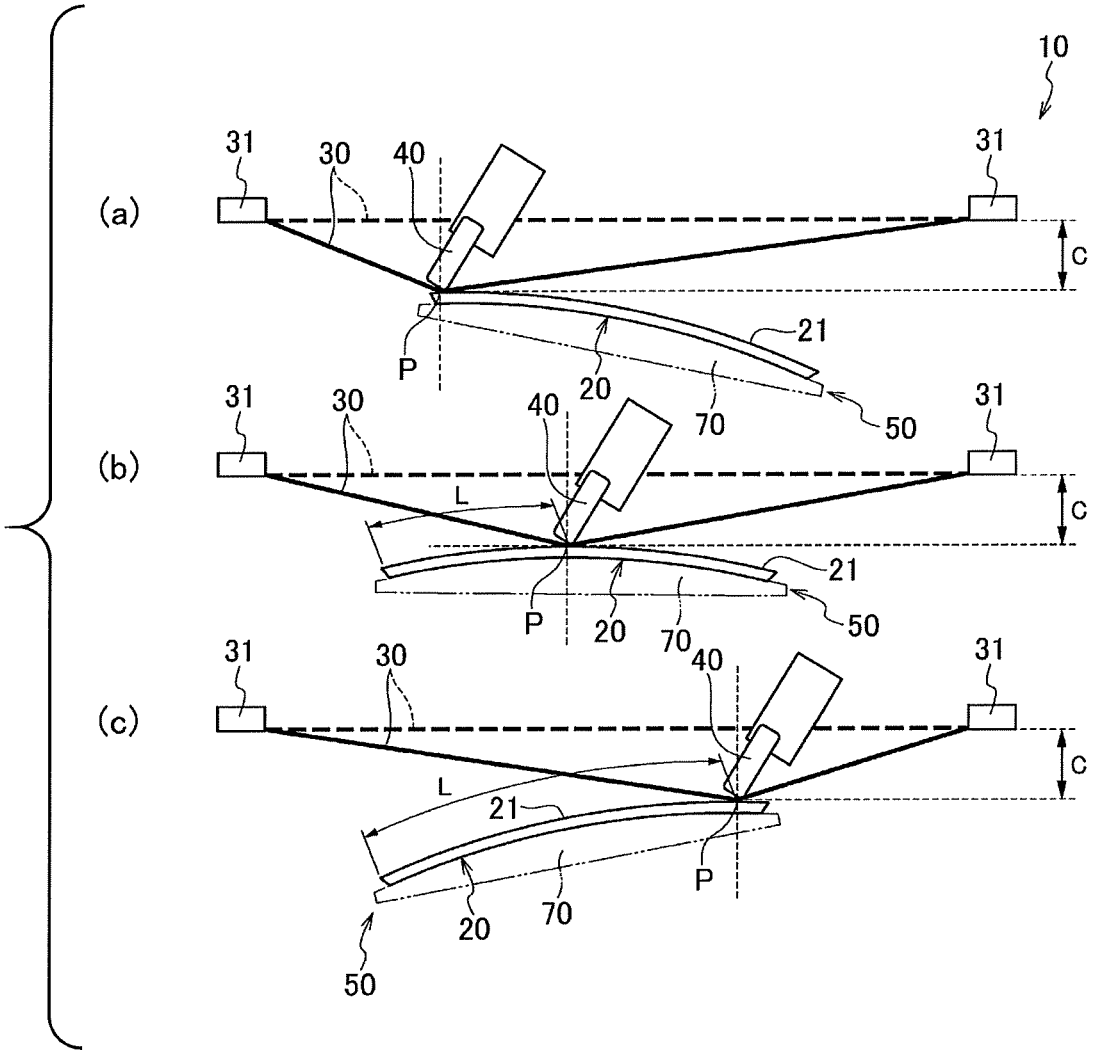
FIGS. 15(*a*), (*b*) and (*c*) of FIG. 15 are schematic diagrams illustrating an operating state of a curved surface screen printing apparatus according to a third embodiment of the present invention.

A curved surface screen printing apparatus 10 of a third embodiment includes a pedestal 70 that holds a base material 20 having a surface 21 to be printed with a curved surface projected upwardly, a base material moving mechanism 50 that drives the base material 20 together with the pedestal 70, a screen plate 30 that is stretched on a frame 31 under a certain tension and installed above the base material 20 through a proper gap C, and a squeegee 40 that is disposed above the screen plate 30 and applies ink to the surface 21 to be printed of the base material 20, as illustrated in FIG. 15.

The squeegee 40 is horizontally moved by a squeegee moving mechanism (not illustrated). Also, as described above, the pedestal 70 has a surface shape substantially the same as that of the surface 21 to be printed of the base material 20, and is driven in synchronization with the squeegee 40 by the base material moving mechanism 50. On the other hand, the screen plate 30 is fixed in a predetermined position.

The curved surface screen printing apparatus 10 of the present embodiment differs from the curved surface screen printing apparatuses 10 of the first and second embodiments in that the screen plate 30 is fixed and the squeegee 40 is horizontally moved by being driven by the squeegee moving mechanism (not illustrated) in synchronization with the base material 20 driven by the base material moving mechanism 50.

Specifically, the base material 20 is driven to move horizontally and vertically along a plane (vertical plane) parallel to a plane of paper of FIG. 15 and swing with respect to the axis orthogonal to the vertical plane (a direction orthogonal to the plane of paper of FIG. 15) so that a gap C between the screen plate 30 before a pressure by the squeegee 40 is applied and a printing position P of the surface 21 to be printed is always maintained constant and so that an attack angle of the squeegee 40 is not changed, that is, an angle formed by the squeegee 40 and a tangent at the printing position P is maintained constant. Also, the squeegee 40 is driven by the squeegee moving mechanism, and is horizontally moved in synchronization with movement of the base material 20 by a distance substantially equal to a creepage distance L along the surface 21 to be printed at the time of moving the base material 20. The squeegee 40 is moved in synchronization with the base material 20 whereby ink is extruded to print a pattern of the screen plate 30 on the surface 21 to be printed.

As described above, the curved surface screen printing apparatus 10 of the third embodiment includes the squeegee moving mechanism that horizontally moves the squeegee 40 in synchronization with movement of the base material 20 by the distance substantially equal to the creepage distance L along the surface 21 to be printed of the base material 20 at the time of moving the base material 20, and the screen plate 30 is fixed in a predetermined position. Therefore, the pattern of the screen plate 30 can be printed with high accuracy on the surface of the base material 20 having a curved surface shape.

Also, according to the curved surface screen printing method of the present embodiment, the screen plate 30 is fixed in a predetermined position, and the squeegee 40 is moved horizontally in synchronization with the movement of the base material 20 while moving the base material 20 along the vertical plane and also swinging the base material 20 with respect to the axis orthogonal to the vertical plane, thereby printing the pattern of the screen plate 30 on the surface 21 to be printed of the base material 20. Therefore, the pattern of the screen plate 30 can be printed with high accuracy on the surface 21 to be printed of the base material 20 having the curved surface shape.

In addition, the present invention is not limited to the embodiments described above, and modifications, improvements and the like can be made properly.

For example, the first embodiment describes the case of performing printing on the single curved projected surface in which the surface 21 to be printed has a uniform circular arc shape. However, in the first embodiment, for example, printing can also be performed on the surface 21 to be printed having a curved surface and a plane surface by using the pedestal as illustrated in FIG. 11.

Figure 16:
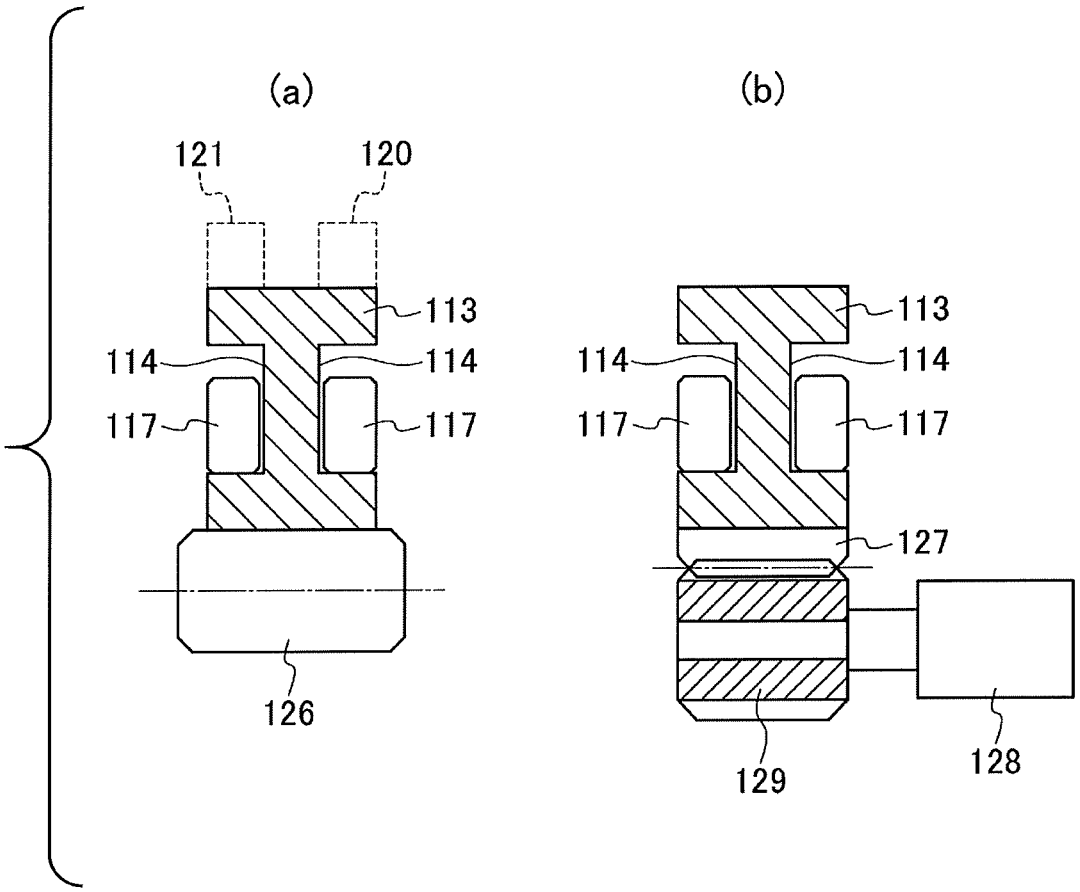
FIG. 16(*a*) of FIG. 16 is an enlarged view of main parts according to a modified example of the base material moving mechanism in the second embodiment, and (b) of FIG. 16 is an enlarged view of main parts according to a modified example in which the base material moving mechanism is electrically synchronized with a screen plate moving mechanism in the second embodiment.

Also, in the second embodiment, as a modified example of the base material moving mechanism illustrated in (a) of FIG. 16, a rotary support 126 may be arranged below the pedestal holder 113 and in an intermediate position (rotatably supported on the movable base 116 in this embodiment) in a movement direction of the pedestal holder 113. Accordingly, the rotary support 126 can partially support a load applied to the pedestal holder 113.

Furthermore, also in the second embodiment, driving of the pedestal holder 113 may be electrically synchronized with the screen plate moving mechanism. In that case, for example, as illustrated in (b) of FIG. 16, a rack 127 is formed on a lower surface of the pedestal holder 113 by performing gear processing, and a pinion gear 129 driven by a motor 128 meshes with the rack 127. And, for example, rotation of an actuator of the screen plate moving mechanism 100 or movement of other components may be read by an encoder (not illustrated) and the pedestal holder 113 may be directly driven by rotating the motor 128 so that the pedestal holder 113 is moved in electrical synchronization with the screen plate moving mechanism 100.

Also, the curved surface formed on the surface to be printed of the base material may be any curved surface formed of, for example, an ellipse other than the circular arc as well as the composite curved surface formed of a single circular arc or a plurality of circular arcs. That is, the axis orthogonal to the vertical plane, around which the base material swing, may be moved in a process of printing on the curved surface.

Accordingly, in screen printing, the base material moving mechanism of the first embodiment swings the base material by the swing driving motor and at the same time, moves the base material along the vertical plane by the horizontal driving motor and/or the vertical driving motor. Thus, the base material is swung with respect to the axis orthogonal to the vertical plane. Also, the base material moving mechanism of the second embodiment includes the pedestal holder having the cam groove and the cam shape of the cam groove is formed according to an arbitrary curved surface. Thus, the base material is swung with respect to the axis orthogonal to the vertical plane.

The present application is based on Japanese patent application No. 2015-226119 filed on Nov. 18, 2015, the contents of which are incorporated herein by reference.

REFERENCE SIGNS LIST

10 Curved surface screen printing apparatus
20 Base material
21 Surface to be printed (Curved surface)
30 Screen plate
40 Squeegee
50,50A Base material moving mechanism
53 Horizontal moving table
54 Horizontal driving motor
56 Vertical driving motor
58 Vertical moving table
59 Swing driving motor
60 Swinging table
70,70A Pedestal
75 Suction mechanism
100 Screen plate moving mechanism
101 Actuator
112 Driving member
112*a* First movement direction end
112*b* Second movement direction end
113 Pedestal holder
113*a* First movement direction end
113*b* Second movement direction end
114 Cam groove
116 Movable Base (Base)
117 Cam follower
120 First chain
120*a* First end
121 Second chain
121*a* Second end
C Gap
L Creepage distance along surface to be printed

The invention claimed is:

1. A screen printing apparatus for printing on a curved surface of a base material, comprising:

a screen plate formed with a pattern;

a squeegee fixed at a printing position and configured to apply an ink to a curved surface of a base material through the screen plate; and a base material moving mechanism comprising a pedestal and configured such that the pedestal holds the base material and swings the curved surface of the base material in synchronization movement with the screen plate with respect to the squeegee fixed at the printing position, wherein the base material moving mechanism comprises a horizontal moving table configured to move in a horizontal direction, a horizontal driving mechanism that drives the horizontal moving table to move in the horizontal direction, a vertical moving table positioned on the horizontal moving table and configured to move in a vertical direction orthogonal to the horizontal direction, a vertical driving mechanism that drives the vertical moving table to move in the vertical direction, a swinging table positioned on the vertical moving table and configured to rotate about an axis orthogonal to the horizontal direction and the vertical direction, and a swing driving mechanism that drives the swinging table to rotate about the axis.

2. The screen printing apparatus according to claim 1, further comprising:

a screen plate moving mechanism comprising an actuator which moves the screen plate horizontally in synchronization with movement of the base material on the pedestal.

3. The screen printing apparatus according to claim 2, wherein the horizontal driving mechanism, the vertical driving mechanism and the swing driving mechanism drive the base material in electrical synchronization with the screen plate moving mechanism.

4. The screen printing apparatus according to claim 2, wherein the base material moving mechanism is positioned on a lower side of the screen plate.

5. The screen printing apparatus according to claim 2, wherein the pedestal has a surface shape which is substantially the same as a surface shape of the curved surface and is projected upwardly.

6. The screen printing apparatus according to claim 2, wherein the pedestal has a front surface made of a resin.

7. The screen printing apparatus according to claim 2, wherein the pedestal has a volume resistivity of $10^9$ Ωm or less.

8. The screen printing apparatus according to claim 2, wherein the pedestal comprises a suction mechanism that vacuum-sucks and holds the base material.

9. The screen printing apparatus according to claim 1, wherein the base material moving mechanism is positioned on a lower side of the screen plate.

10. The screen printing apparatus according to claim 9, wherein the pedestal has a surface shape which is substantially the same as a surface shape of the curved surface and is projected upwardly.

11. The screen printing apparatus according to claim 9, wherein the pedestal has a front surface made of a resin.

12. The screen printing apparatus according to claim 1, wherein the pedestal has a surface shape which is substantially the same as a surface shape of the curved surface and is projected upwardly.

13. The screen printing apparatus according to claim 1, wherein the pedestal has a front surface made of a resin.

14. The screen printing apparatus according to claim 1, wherein the pedestal has a volume resistivity of $10^9$ Ωm or less.

15. The screen printing apparatus according to claim 1, wherein the pedestal comprises a suction mechanism that vacuum-sucks and holds the base material.

16. A screen printing method for printing on a curved surface of a base material, comprising:

fixing a squeegee at a printing position such that the squeegee applies an ink to the curved surface of the base material through a screen plate;

holding the base material on a pedestal of a base material moving mechanism; and swinging the curved surface of the base material held on the pedestal in synchronization movement with the screen plate with respect to the squeegee fixed at the printing position, wherein the base material moving mechanism comprises a horizontal moving table configured to move in a horizontal direction, a horizontal driving mechanism that drives the horizontal moving table to move in the horizontal direction, a vertical moving table positioned on the horizontal moving table and configured to move in a vertical direction orthogonal to the horizontal direction, a vertical driving mechanism that drives the vertical moving table to move in the vertical direction, a swinging table positioned on the vertical moving table and configured to rotate about an axis orthogonal to the horizontal direction and the vertical direction, and a swing driving mechanism that drives the swinging table to rotate about the axis.

17. A method for manufacturing a print layer-attached base material, comprising:

providing a screen printing apparatus comprising a screen plate formed with a pattern, a squeegee fixed at a printing position and configured to apply an ink to a curved surface of a base material through the screen plate, and a base material moving mechanism comprising a pedestal and configured such that the pedestal holds the base material and swings the curved surface of the base material in synchronization movement with the screen plate with respect to the squeegee fixed at the printing position; and holding the base material on the pedestal of the base material moving mechanism; and swinging the curved surface of the base material held on the pedestal in synchronization movement with the screen plate with respect to the squeegee fixed at the printing position, wherein the base material moving mechanism comprises a horizontal moving table configured to move in a horizontal direction, a horizontal driving mechanism that drives the horizontal moving table to move in the horizontal direction, a vertical moving table positioned on the horizontal moving table and configured to move in a vertical direction orthogonal to the horizontal direction, a vertical driving mechanism that drives the vertical moving table to move in the vertical direction, a swinging table positioned on the vertical moving table and configured to rotate about an axis orthogonal to the horizontal direction and the vertical direction, and a swing driving mechanism that drives the swinging table to rotate about the axis.

18. The method for manufacturing the print layer-attached base material according to claim 17, wherein the screen plate is horizontally moved in synchronization with movement of the base material.

19. The method for manufacturing the print layer-attached base material according to claim 17, wherein the base material is moved by the base material moving mechanism positioned on a lower side of the screen plate.

20. The method for manufacturing the print layer-attached base material according to claim 17, wherein the pedestal has a surface shape which is substantially the same as a surface shape of the curved surface of the base material and is projected upwardly.

21. The method for manufacturing the print layer-attached base material according to claim 17, wherein the pedestal has a volume resistivity of $10^9$ Ωm or less.

* * * * *